United States Patent [19]

Grant

[11] 4,232,691

[45] Nov. 11, 1980

[54] PROCESSING OF SHEET MATERIAL IN A LIQUID BATH

[76] Inventor: Sidney Grant, 46 Salmon St., Kingsbury, London N.W.9, England

[21] Appl. No.: 9,353

[22] Filed: Feb. 5, 1979

[30] Foreign Application Priority Data

Feb. 7, 1978 [GB] United Kingdom ..... 4916/78

[51] Int. Cl.[3] ..... G03D 3/12

[52] U.S. Cl. ..... 134/104; 15/256.6; 134/64 P; 198/626; 354/322

[58] Field of Search ..... 354/316, 319, 320, 321, 354/322; 226/88, 170, 171, 172, 173, 174, 181, 182, 183, 184, 185, 193, 195; 134/64 P, 122 P, 104; 198/497, 626, 499; 15/256.6

[56] References Cited

U.S. PATENT DOCUMENTS

| | | | |
|---|---|---|---|
| 1,589,595 | 6/1926 | Hitchcock | 226/193 |
| 2,724,254 | 11/1955 | Zanger | 354/322 |
| 2,885,069 | 5/1959 | Bowen | 15/256.5 X |
| 2,927,503 | 3/1960 | Zollinger | 354/321 |
| 3,033,351 | 5/1962 | Dutch | 198/626 |
| 3,056,164 | 10/1962 | Reichel et al. | 226/193 |
| 3,072,037 | 1/1963 | Hixon et al. | 198/626X |
| 3,311,039 | 3/1967 | Lucas | 134/122 P |
| 4,105,109 | 8/1978 | Schultz | 198/499 |

FOREIGN PATENT DOCUMENTS

| | | | |
|---|---|---|---|
| 2516357 | 10/1976 | Fed. Rep. of Germany | 354/312 |
| 673896 | 1/1930 | France . | |

*Primary Examiner*—L. T. Hix
*Assistant Examiner*—Alan Mathews
*Attorney, Agent, or Firm*—Blanchard, Flynn, Thiel, Boutell & Tanis

[57] ABSTRACT

Apparatus for processing sheet material in a bath of liquid comprising a pair of drivable endless bands between which the sheet material is held to carry it through the liquid bath in a container. The bands are permeable to allow access of the liquid to the sheet and follow a path between stationary scraper bars which guide the bands to follow a slightly sinuous path, thereby ensuring contact between the bands, and which press the liquid through the permeable bands. Conveniently the bands, which are of woven material and driven by splined rollers, follow a generally U-shaped path within the container. For processing X-ray films in piece or strip form a series of processing units are used side by side with a common drive system.

10 Claims, 4 Drawing Figures

PROCESSING OF SHEET MATERIAL IN A LIQUID BATH

Figure 1:
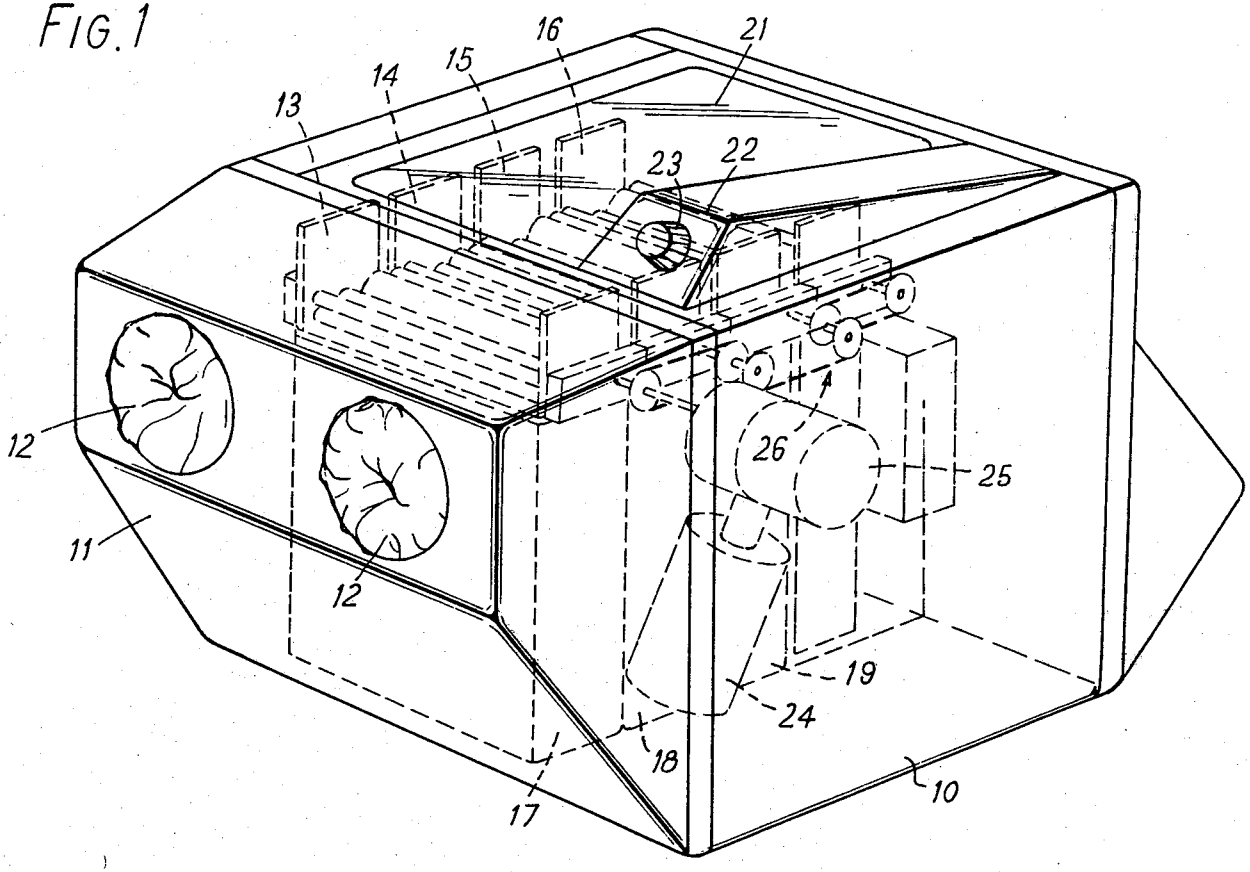

The present invention relates to apparatus for processing sheet material in a bath of liquid in a container, for example for developing photographic film.

Existing processors for photographic film are either designed to deal with roll films, in which case the strip of film is guided and in some cases driven by rollers disposed above the bath and if necessary additional rollers disposed at the bottom of the bath, or are designed to deal with individual pieces of film and have a multiplicity of pairs of rollers which are closely spaced to support and transport the film through the bath. While the former type of processor is entirely satisfactory for the purpose for which it is used, it is incapable of handling film which is not in strip form. The latter type of processor, in order to be able to handle a wide range of film sizes, has to have large numbers of rollers and quite apart from the complexity and expense of the mechanism necessary for mounting and driving such rollers, it is difficult to maintain the rollers in a satisfactory operating condition such that they transport the film smoothly and without damage. The rollers easily get out of alignment and pick up dirt and deposits from the film itself and from the developing solutions.

When handling small pieces of film it is possible for these to be lost between the rollers. Roll film may become wrapped around a roller, which results in loss of the film and requires the machine to be dismantled to extract the damaged film.

To overcome these difficulties the present invention provides apparatus for processing sheet material in a bath of liquid in a container comprising a pair of drivable endless bands arranged to receive the sheet material between the bands, hold the material between the bands to transport the material through the container, and deliver the material from between the bands after immersion in the liquid, wherein at least one of the bands is composed of permeable material to allow access of liquid to the side of the sheet material in contact with the permeable band and the bands pass between guide members which are mounted in the container to extend transverse to the bands and engage the outer faces of the bands, the guide members being spaced along the path of travel of the bands and those guide members which engage the permeable band acting to move liquid through the band.

Apparatus with a single permeable band is adequate when only one side of the sheet material has to be contacted by the liquid, for example in the case of photographic film with an emulsion on one side only. Preferably, however, both bands are permeable so that the liquid contacts both sides of the sheet material. This is desirable not only when the sheet material is to be treated on both sides, but also, for example, when the liquid is wash water for removing solutions applied to the sheet material in earlier stages of its processing.

The guide members are preferably scraper bars each having an edge which engages the outer face of one of the bands. The edge may be defined between two surfaces which are disposed in a V-formation. Conveniently the bars are composed of a rigid synthetic plastics material which is inert to the action of the liquid. Alternatively the guide members might be formed by rollers, allowing existing processing apparatus to be converted by addition of bands and removal of some of the rollers. In such a case it may be preferable to prevent rotation of the rollers so that they rub against the faces of the bands.

While the apparatus to be described is primarily intended for handling individual pieces of material and can easily accomodate a wide range of sizes it is also capable of being used with strips of material which can be transported between the bands in exactly the same way as individual pieces.

The permeable material of the bands is preferably a woven material such as a woven polyester mesh because this provides ready access of liquid to the surfaces of the sheet material held between the bands while satisfying the mechanical requirements for driving of the bands and transport of the sheet material. It will be appreciated that a woven material has a regular pattern of small openings for the passage of liquid and also a surface configuration which contacts the sheet material at an array of points while allowing for access of liquid all around those points. It will be seen from the following description that a band which is flexible but will not stretch and which contacts the sheet lightly at a large number of points best satisfies the mechanical requirements. Thus a woven material is preferred but it may also be possible to achieve comparable results with a sheet material which although not of woven construction shares some of the physical characteristics of a woven sheet.

The guide members are preferably so positioned that the bands follow a somewhat sinuous course between the guide members, thus ensuring that the bands are not allowed to separate from one another while passing through the bath and therefore maintain their hold on the sheet material.

Guide members in the form of scraper bars, which in effect replace many of the pairs of rollers in the prior machines, are simpler to construct and mount, are kept clean by immersion in the liquid and by constant passage of the bands and do not come into direct contact with the sheet material.

Figure 2:
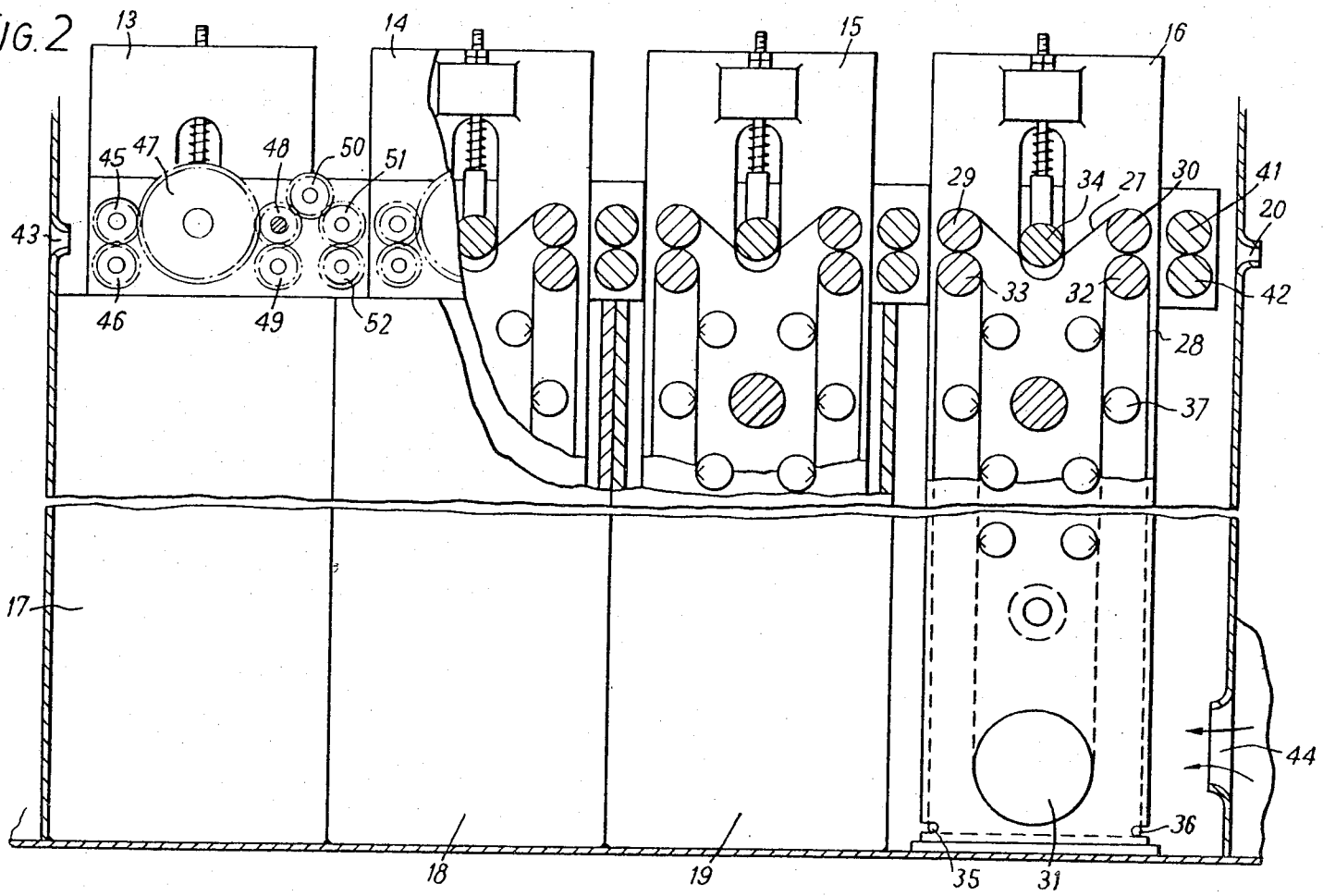
Figure 3:
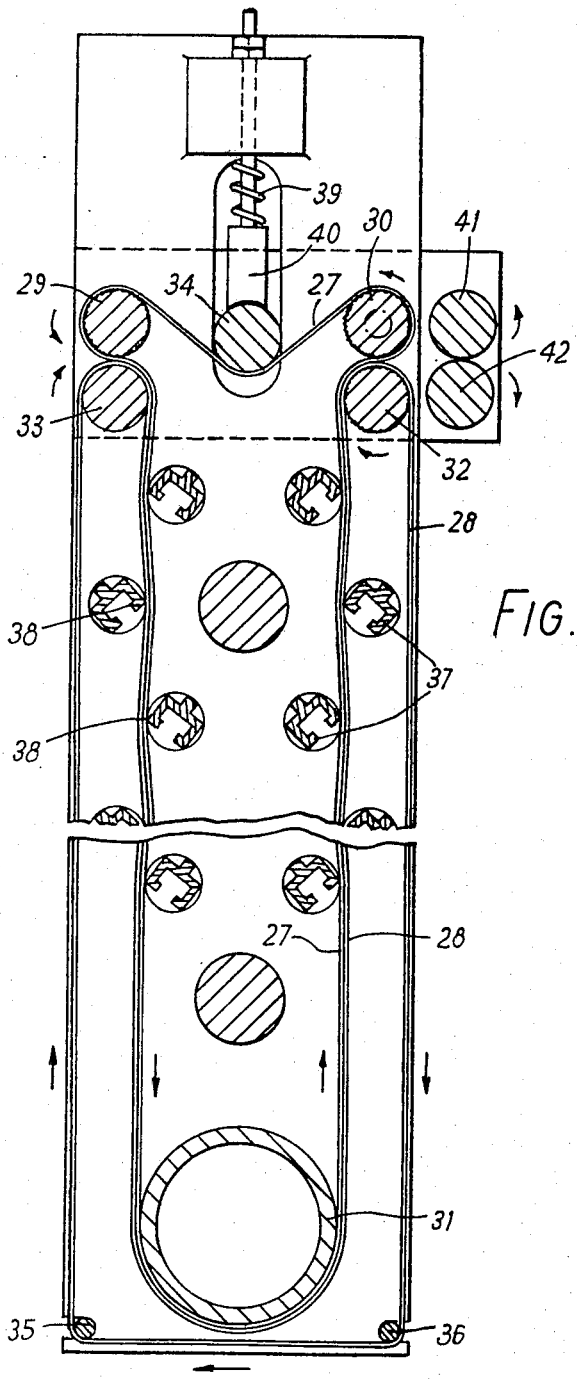
Figure 4:
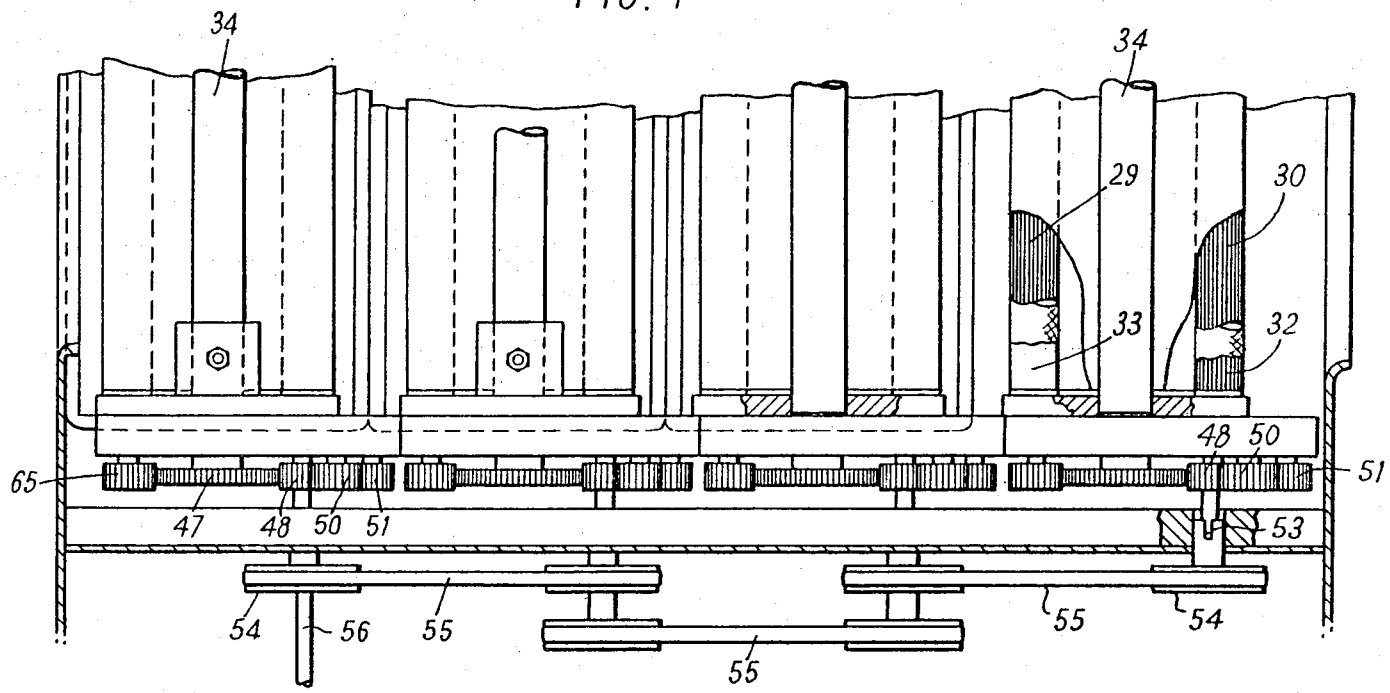

For driving the bands it is preferred to use rollers which are splined or grooved in a direction parallel to the axis of rotation so that they grip the bands to advance them but do not have any tendency to create a sideways force on the bands. The bands can then be edge-guided without danger of rucking and creasing. It has been found sufficient to use two drive rollers for one of the bands, the band being lightly tensioned to ensure good engagement with the drive rollers, and for the other band to have a single drive roller and an idler roller, without any band tensioning device, and to rely on contact between the bands to ensure that they advance in synchronism through the bath. In the preferred arrangement the drive rollers and idler roller are disposed at the top of the container, outside the liquid, and the bands follow a generally U-shaped path through the liquid, guided by the scraper bars and by a fixed cylindrical guide at the bottom of the container. The return path for one band is across the top of the container, where it is acted upon by a spring-loaded tensioning rod extending parallel to the rollers, and for the other band is close to the walls of the container, outside the path defined by the scraper bars.

the invention will now be described in more detail with the aid of an example illustrated in the accompanying drawings, in which:

FIG. 1 is a general perspective view of apparatus in accordance with the invention designed for development of dental X-ray films, with the internal components shown in outline, FIG. 2 is a side view, with parts in section, of the main processing units of the apparatus of FIG. 1 with their film transport mechanisms, FIG. 3 is a more detailed section on a larger scale of the transport mechanism of one of the processing units shown in FIG. 2, and FIG. 4 is a top view, with parts cut away, of one side of the processing units shown in FIG. 2, showing the drive system for the rollers of the transport mechanism.

Referring first to FIG. 1, this shows a processor for dental X-ray films which has a main housing 10, to one end of which is fitted a light-tight box 11 with diaphragms 12 through which the operator's hands can be inserted into the box 11 with the film to be developed. The film is then removed from its wrappings and inserted into a slot where it is taken up by the transport mechanism of the first of four processing units. The four transport mechanisms 13, 14, 15 and 16 are of identical construction. The first three 13, 14, and 15 are disposed in respective rectangular tanks 17, 18 and 19 which contain conventional solutions for processing the film and, in the tank 19, wash water for washing away traces of the solutions. The transport mechanism 16 is located in a warm air chamber to dry the film before it emerges from a slot 20 (FIG.2) at the rear end of the processor.

An appropriately coloured window 21 is fitted in the top wall of the housing 10 which also carries a control panel 22 with indicator lights and a control knob 23. The drive to the four transport mechanisms is provided by an electric motor 24 through a reduction gear 25 and a transmission 26 which will be described in more detail with reference to FIGS. 2 and 4. Provision is made for heating the solutions in the tanks 17 and 18, if required, and for circulating wash water through the tank 19 but these details have been omitted from the drawings in the interests of clarity.

Each of the transport mechanisms 13 to 16 comprises two side plates between which are mounted driving rollers and guides for two endless bands 27 and 28 (see especially the mechanism 16 in FIG. 2 and FIG. 3). The band 27 runs over two driving rollers 29 and 30 disposed at the upper end of the side plates and passes around a fixed guide cylinder 31 close to the bottom of the side plates. The band 28 runs over a driving roller 32 and a driven idler roller 33 and follows the same generally U-shaped path around the guide cylinder 31 but whereas the return run of the band 27 is between the rollers 29 and 30, where it is held under tension by a spring-loaded tensioning rod 34, the return run of the band 28 is around the outside of the U-shaped path of the two bands, close to the edges of the side plates, guided by rods 35 and 36 at the bottom corners of the side plates. The U-shaped path which the two bands traverse together extends from the rollers 29 and 33, down to the guide cylinder 31 and back up to the rollers 30 and 32. Throughout this path the bands are guided by scraper bars 37, which are only shown schematically in FIG. 2. The scraper bars 37, whose cross-section is shown in FIG. 3 and which are mounted at their ends in openings in the side plates, are disposed alternately on the two sides of the path of travel of the bands and have edges 38 which engage the outer surface of the adjacent band 27 or 28.

The scraper bars 37 with the cross-section shown in FIG. 3 can conveniently be replaced by bars of triangular or V-shaped cross-section, the edge 38 lying at an apex of the triangle or the apex of the V. The positioning of the edges 38 is such that, as seen in the upper part of FIG. 3, the bands are caused to follow a slightly sinuous course along the U-shaped path and therefore will not separate from one another.

If desired additional scraper bars can be incorporated and these may be positioned directly opposite the bars shown so that the bands pass between pairs of scraper bars.

Tension is maintained in the band 27 by the rod 34 which is acted upon at each end by a spring 39 through a shoe 40. Alternatively, the rod 34 can be acted upon directly by an arm extending from a coil spring whose axis is parallel to the axis of the rod. The band 27 is driven by the rollers 29 and 30 but the band 28 is only pulled through the processing zone by the drive due to the roller 32, the roller 33 being driven but having a smooth surface which exerts little driving force on the band. The band 28 is also to some extent driven by contact with the band 27.

Thus when a piece of film is placed between the bands at the nip of the rollers 29 and 33, the band 28 has some slack and can slip to accomodate the thickness of the film but after this the contact between the bands passing from one scraper bar to another and the drive due to the rollers 30 and 32 ensures smooth continuous advance of the film through the processing zone until it is delivered from between the bands at the nip of the rollers 30 and 32. Each transport mechanism is provided with two additional transport rollers 41 and 42 which serve to transfer the film from the nip of the rollers 30 and 32 of that mechanism to the rollers 29 and 33 at the input side of the next mechanism. The driven transport rollers 41 and 42 could be replaced by stationary guides.

Thus, referring to FIG. 2, a piece of film inserted through a slot 43 at the left-hand side will be automatically taken up and transported in succession through the tanks 17, 18 and 19 and the drying zone occupied by the mechanism 16 and will be delivered through the slot 20 at the right-hand side. Hot air is delivered to the drying zone by way of a slot 44 as indicated at the right-hand side of FIG. 2.

The drive system for the various rollers 29, 30, 32, 33, 41 and 42 of the several transport mechanisms 13 to 16 can be seen in FIG. 4 and at the left-hand side of FIG. 2. The input rollers 29 and 33 are fitted at one end with meshing pinions 45 and 46, respectively. The pinion 45 is in engagement through an idler gear 47 with a driven pinion 48. The pinion 48 is fitted to the roller 30 and drives a pinion 49 fitted to the roller 32. The pinion 48 also drives, through an idler 50, a pinion 51 fitted to the roller 41, the pinion 51 in turn driving a pinion 52 fitted to the roller 42. The drive to the pinion 48 is in each case provided through a disengageable coupling 53 (see at the right of FIG. 4) from a respective pulley 54, the pulleys 54 being driven in synchronism by bands 55 connecting the pulleys to an output shaft 56 of the reduction gear 25 (FIG. 1). The coupling 53 allows each transport mechanism 13 to 16, together with its meshing pinions, to be uncoupled from the drive and removed from the apparatus as a unit for inspection, maintenance and replacement, if needed.

It is clear from FIG. 4, and is also shown in FIG. 2, that whereas the idler roller 33 is a metal roller with a smooth surface, the driven rollers 29, 30 and 32 are metal rollers with splined or grooved surfaces. It is important that the grooves or splines run parallel to the axis of rotation so that while they grip the bands 27 and 28 to advance them they do not create a sideways force on the bands and the bands are free to move sideways to align themselves between the side plates of the transport mechanism.

The material used for the bands 27 and 28 is a woven polyester mesh of the type used for screen printing. The use of different mesh sizes for the two bands helps to prevent sticking of one band to the other which can lead to irregularities in the drive. In the apparatus described the band 27 has 40 threads per linear centimeter with a thread diameter of 90 micron. The apertures between the threads are 160 micron and the open area is 40% of the total. The band 28 has 34 threads per linear centimeter with a thread diameter of 100 micron. The aperture size is 195 micron giving an open area which is 43% of the total area.

I claim:

1. Apparatus for processing sheet material in a bath of liquid comprising a container for the liquid, a pair of drivable endless bands, means driving said bands and means mounting the bands to receive the sheet material between the bands, hold the material between the bands to transport the material through the container, and deliver the material from between the bands after immersion in the liquid, wherein at least one of the bands is composed of permeable material to allow access of liquid to the side of the sheet material in contact with the permeable band and guide members are mounted in the container to extend transverse to the bands and engage the outer faces of the bands, said bands passing between said guide members, wherein the permeable band is composed of a synthetic fabric and the guide members are scraper bars positioned for defining a sinuous path for the bands, said scraper bars having edges which engage the outer faces of the bands and serve to move liquid through the permeable band and scrape dirt therefrom.

2. Apparatus as claimed in claim 1 wherein both bands are composed of permeable synthetic fabric.

3. Apparatus as claimed in claim 1 in which the permeable material of the band(s) is a woven polyester mesh and the two bands between which the sheet material is to be received are of different mesh size, to help prevent sticking together of said bands.

4. Apparatus as claimed in claim 1 in which the driving means include drive rollers for the bands, each drive roller having grooves or splines running parallel to the axis of rotation of the roller.

5. Apparatus as claimed in claim 1 wherein said scraper bar edge is defined between two surfaces disposed in a V-formation, said sinuous path of the bands being shallow, the scraper bar edges alternating on opposite sides of the band sheet intruding only to a minimum extent into the path of the bands to minimize deflection of the bands thereby, such that scrapers on opposite sides of the bands do not significantly overlap each other.

6. Apparatus as claimed in claim 1 in which the driving means include an outlet pair of drive rollers between which the bands pass at the point at which said bands deliver said sheet material, and two additional transport rollers for transferring the material from the nip of said outlet pair of drive rollers to a point downstream therefrom.

7. Apparatus for processing sheet material in a bath of liquid comprising a container for the liquid, a pair of drivable endless bands, means driving said bands and means mounting the bands to receive the sheet material betwen the bands, hold the material between the bands to transport the material through the container, and deliver the material from between the bands after immersion in the liquid, wherein at least one of the bands is composed of permeable material to allow access of liquid to the side of the sheet material in contact with the permeable band and guide members are mounted in the container to extend transverse to the bands and engage the outer faces of the bands, said bands passing between said guide members, the guide members being spaced along the path of travel of the bands and those guide members which engage the permeable band acting to move liquid through the band, wherein the driving means include drive rollers for the bands, the drive rollers having a textured surface, in which one band passes over two drive rollers and the other band passes over a single drive roller and an idler roller.

8. Apparatus as claimed in claim 7 wherein the idler roller has a smooth surface so as to exert less driving force on said bands than said drive rollers and permit sufficient slippage thereon of the band passing thereover as to accomodate insertion of the thickness of the sheet material between the bands at the nip between said idler roller and the opposed drive roller.

9. Apparatus for processing sheet material in a bath of liquid comprising a container for the liquid, a pair of drivable endless bands, means driving said bands and means mounting the bands to receive the sheet material between the bands, hold the material between the bands to transport the material through the container, and deliver the material from between the bands after immersion in the liquid, wherein at least one of the bands is composed of permeable material to allow access of liquid to the side of the sheet material in contact with the permeable band and guide members are mounted in the container to extend transverse to the bands and engage the outer faces of the bands, said bands passing between said guide members, the guide members being spaced along the path of travel of the bands and those guide members which engage the permeable band acting to move liquid through the band, wherein the driving means include drive rollers in which one band passes over two said drive rollers, and including a spring-loaded tensioning rod acting on the said one band between the two drive rollers.

10. Apparatus for processing sheet material in a bath of liquid comprising a container for the liquid, a pair of drivable endless bands of permeable synthetic fabric, first means guiding said bands together in an approximately U-shaped path between a reception zone and a delivery zone both located above the container, said U-shaped path lying within the container, and further guide means guiding said band along separate return paths from said delivery zone to said reception zone, said first guide means including scraper bars mounted in the container transverse to the bands and having edges which engage the outer faces of the bands along said U-shaped path, drive means for said bands and tensioning means acting on at least one of said bands.

* * * * *